United States Patent [19]

Garwood et al.

[11] Patent Number: 4,756,563

[45] Date of Patent: Jul. 12, 1988

[54] VEHICLE DOOR LATCH

[75] Inventors: Stephen K. Garwood, Leighton Buzzard, England; Jeffrey L. Konchan, Warren, Mich.

[73] Assignee: General Motors Corporation, Detroit, Mich.

[21] Appl. No.: 895,195

[22] Filed: Aug. 11, 1986

[51] Int. Cl.[4] ..... E05C 3/26

[52] U.S. Cl. ..... 292/216; 272/337

[58] Field of Search ..... 292/216, 280, 337, 201

[56] References Cited

U.S. PATENT DOCUMENTS

| | | | |
|---|---|---|---|
| 1,192,733 | 7/1916 | Bennett | 292/341.14 X |
| 2,100,591 | 11/1937 | Haberstump | 292/341.14 X |
| 3,415,559 | 12/1968 | Jeavons | 292/216 |
| 3,520,159 | 7/1970 | Swanney | 292/216 X |
| 4,097,078 | 6/1978 | Tack et al. | 292/198 X |
| 4,165,112 | 8/1979 | Kleefeldt | 292/341.12 X |
| 4,258,945 | 3/1981 | Pouget | 292/201 X |
| 4,364,590 | 12/1982 | Hamada | 292/280 X |
| 4,466,645 | 8/1984 | Kobayashi | 292/341.12 |
| 4,518,182 | 5/1985 | Cousin et al. | 292/216 X |
| 4,538,845 | 9/1985 | Yamada | 292/337 X |
| 4,575,138 | 3/1986 | Nakamura et al. | 292/337 X |
| 4,586,737 | 5/1986 | Arlauskas | 292/216 |

FOREIGN PATENT DOCUMENTS

| | | | |
|---|---|---|---|
| 2401295 | 4/1979 | France | 292/216 |
| 2424392 | 12/1979 | France | 292/216 |
| 47703 | 3/1977 | Japan | 292/216 |
| 442916 | 2/1936 | United Kingdom | 292/341.12 |
| 1430230 | 3/1976 | United Kingdom | 292/216 |

*Primary Examiner*—Gary L. Smith
*Assistant Examiner*—Eric K. Nicholson
*Attorney, Agent, or Firm*—Herbert Furman

[57] ABSTRACT

A fork type bolt vehicle door latch includes a plastic housing which opens through one wall to receive the operating components of the latch in stacked relationship. A frame member closes the one open wall of the housing member. The operating levers of the latch are located adjacent the bottom thereof to permit the latch to be used in both front and rear door applications. The frame member and plastic housing are interconnected by intermediately flanged bushings which are internally threaded to receive mounting bolts for mounting the latch to a vehicle door. One of the bushings and the frame member trap the engaged shoulders of the bolt and detent therebetween.

3 Claims, 3 Drawing Sheets

VEHICLE DOOR LATCH

This invention relates generally to vehicle door latches and more particularly to an improved fork bolt type vehicle door latch.

Fork bolt type vehicle door latches are well known and have been used in production for many years. The latch of this invention has several features which provide an improved door latch.

One feature is that the latch includes a plastic housing member having an open side for receiving the components of the latch in a stacked assembly process. This provides for ease of assembly of the housing member and the latch components since the housing remains in the same horizontal attitude during assembly of the housing and components.

Another feature is that a cover or frame member covers the open side of the plastic housing member. The frame member seats on recessed ledges of the housing member, and, when assembled thereto, provides a substantially sealed latch housing. The only openings into the latch housing are for the entry of the striker into engagement with the fork type latch bolt and for the exit of the operating levers of the latch. The substantially sealed latch housing greatly reduces water entry and resultant sealing and lubrication problems.

A further feature is that the frame member and the forward side of the plastic housing are planar to provide for ease of mounting of the door latch on either a wall of a vehicle body door or on components of the door, such as the door beam or a door latch control module or unit.

Yet another feature is that the operating levers, including the locking levers and the unlatching levers, are located at the bottom of the latch housing. This permits the latch to be used in both front and rear doors of vehicles without the need for any additional auxiliary levers.

Yet a further feature is that the frame member and the housing member are assembled to each other by a number of like cylindrical bushings which seat in respective recesses of the housing member and engage the frame member. Each bushing further has an intermediate flange which seats on a recessed wall or portion of the plastic housing member. The bushings are hollow and internally threaded to receive the mounting bolts which secure the latch to the door. Certain of the bushings provide pivots for the latch bolt and detent.

Still another feature is that one of the bushings is located adjacent to the detent shoulder so that the flange of the bushing and the frame member effectively trap the detent and bolt shoulders therebetween when such shoulders are in latching engagement. This resists bypass of the detent and bolt shoulders relative to each other.

Still a further feature is that the door latch is intended for use with a loop type striker. The bight of the striker includes a molded on plastic wedge which is engageable with wedge surfaces of the housing to resist relative movement between the door and the vehicle body when the door is in latched position. Since the leg of the loop type striker engaged by the bolt is not covered in any manner, the bolt throat receiving such leg can be of a minimum size to increase the strength of the latch, while reducing the overall door latch size and mass.

These and other features of the door latch of this invention will be readily apparent from the following specification and drawings wherein.

Figure 1:
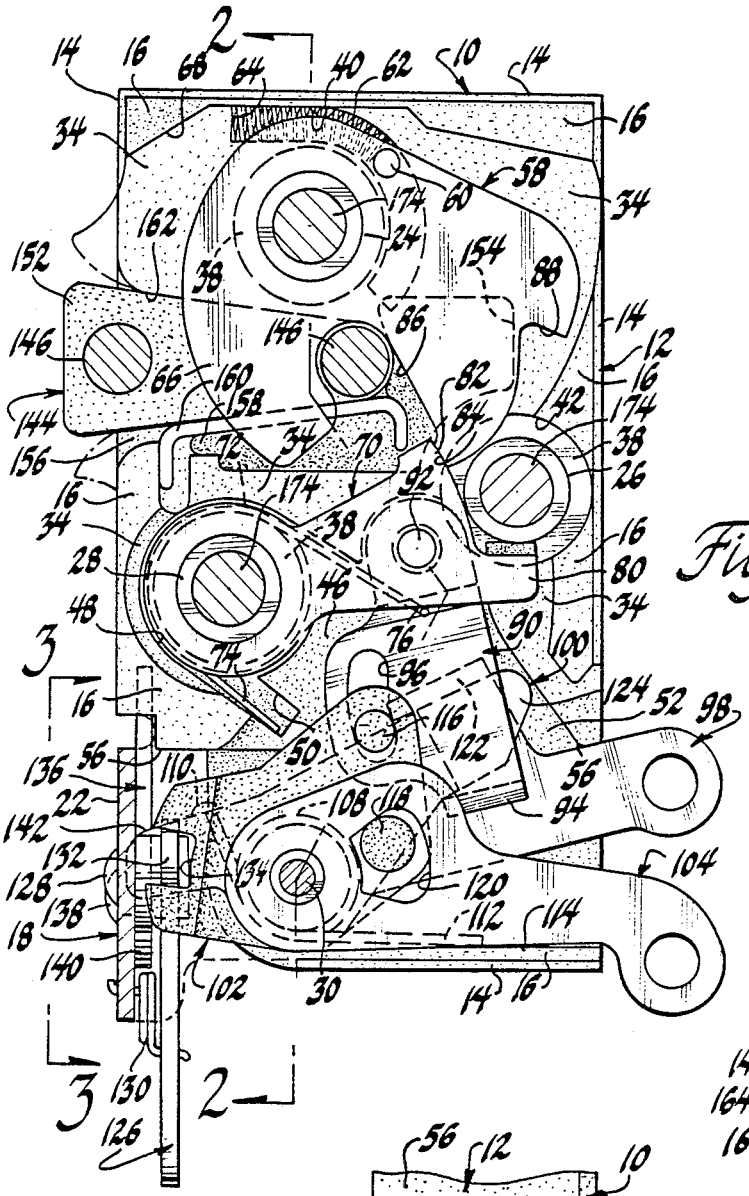
FIG. 1 is a partially broken away view showing the door latch in an unlocked condition and the latch bolt in latched position.
Figure 2:
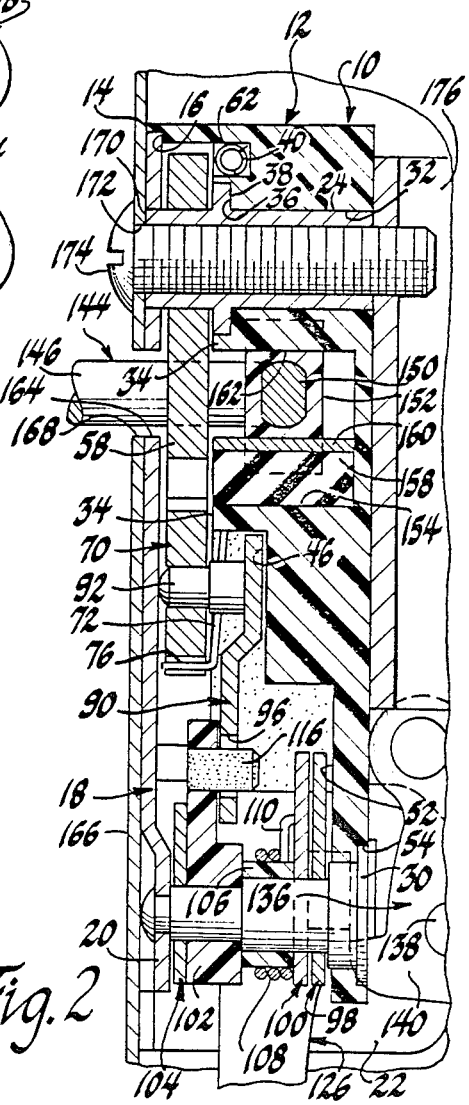
FIG. 2 is a sectional view taken along line 2—2 of FIG. 1.
Figures 7, 8:
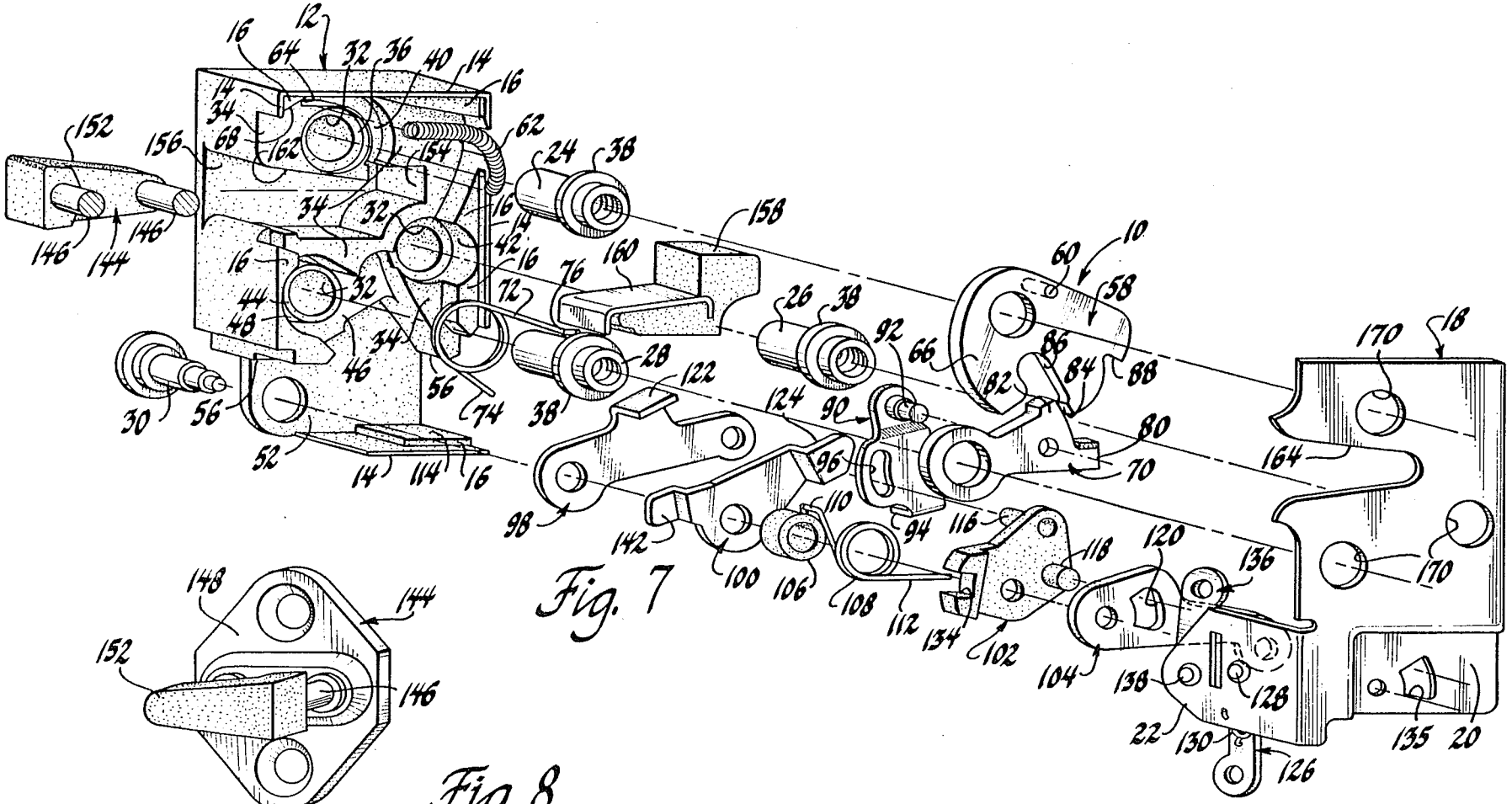
FIG. 7 is a blown apart perspective view.
FIG. 8 is a perspective view of the striker.

Referring to FIGS. 1, 2, 4 and 7 of the drawings, a door latch 10 includes a one piece molded plastic housing member 12 which opens to one side or outer base wall thereof and includes a series of relatively thin peripheral wall portions 14 along the side walls and the upper and lower walls thereof, and also a number of adjacent inwardly recessed first base wall portions 16, all of which are coplanar. A cover or frame member 18, FIG. 7, includes an inwardly recessed lower corner portion 20 and a side flange 22. The frame member 18 fits within the wall portions 14 and seats on the wall portions 16 to close the open base wall of housing member 12. Three like intermediately flanged internally threaded bushings 24, 26 and 28 and a headed shouldered stud 30 extend between the housing member 12 and the frame member 18. As best shown in FIGS. 2 and 7, the housing member 12 includes three like cylindrical apertures 32 which respectively receive the longer cylindrical portions of the bushings 24, 26 and 28. The first aperture 32 for bushing 24 opens to an inwardly recessed second base wall portion 34 of housing member 12. The opening of the first aperture 32 is surrounded by a circular recess 36 which receives flange 38 of the bushing 24. The recess 36 locates the flange 38 coplanar with wall portion 34. An arcuate groove 40 partially surrounds recess 36.

The flange 38 of the bushing 26 is received within a circular recess 42 around a second aperture 32 so as to also be coplanar with an extension of the wall portion 34 as shown in FIG. 1. The flange 38 of the bushing 28 seats on the free end of integral cylindrical portion 44 of the housing member 18 which extends outwardly from an inwardly recessed third base wall portion 46 and defines part of the third aperture 32. The free end of cylindrical portion 44 is recessed with respect to wall portion 34 so that flange 38 of bushing 28 is coplanar with wall portion 34 and with the flanges 38 of bushings 24 and 26.

A circular recess 48 surrounds the base of cylindrical portion 44 and has an extension 50. An inwardly recessed fourth base wall portion 52 of the housing member 12 is apertured to receive the stud 30. The head of the stud and an adjacent shouldered portion of the stud are received within a like shaped recess 54 of housing member 12 as shown in FIG. 2. Wall portion 52 opens outwardly at 56 through the opposite side walls of housing member 12. The frame member 18 seats on the free ends of the shorter cylindrical portions of the bushings 24, 26 and 28 and is apertured in alignment with the threaded interiors thereof. The free shouldered end of stud 30 extends through an aperture of the corner portion 20 and is headed thereover as shown in FIG. 2 to secure the frame member 18 and the housing member 12 to each other.

A fork type bolt 58 is pivotally mounted on the shorter cylindrical portion of the bushing 24 as shown in FIG. 2. A pin 60 extends inwardly from the bolt and seats one end of a coil compression spring 62 which is received within the groove 40. The engagement of the other end of the spring 62 with an end wall 64 of groove 40 provides a bias on the bolt 58 biasing the bolt clockwise from its fully latched position of FIG. 1 to its unlatched position shown in FIG. 4. The engagement of the outer edge of the outboard leg 66 of the bolt with a shoulder 68 between one of the ledge portions 14 and a wall portion 34 locates the bolt 58 in unlatched position against the bias of the spring 62.

A detent 70 is pivoted on the shorter cylindrical portion of the bushing 28. A torsion spring 72 surrounds the cylindrical portion 44 within recess 48. One leg 74 of spring 72 is anchored in extension 50 and the other leg 76 of the spring engages under the detent 70 to bias the detent member counterclockwise as viewed in FIGS. 2, 4 and 5 toward detented position. The detent member is located in this position against the bias of spring 72 by engagement of a rubber bumper covered leg 80 thereof with the shorter cylindrical portion of the bushing 26. The detent member 70 includes a shoulder 82 which is engageable with a shoulder 84 on the inboard leg of the bolt throat 86 as shown in FIG. 1 to locate the bolt in a fully latched position. Although not shown in the drawings, the detent shoulder 82 is also engageable with another shoulder 88 of the bolt to locate the bolt in an intermediate latched position.

An intermittent member 90 is pivoted at 92 to the detent 70 so as to be located in depending relationship to the detent. The intermittent member includes a lower lateral tab 94 and an arcuate slot 96.

As shown in FIG. 2, the shouldered stud 30 extends between the housing member 12 and the recessed corner portion 20 of the frame member 18 to secure these members to each other as well as space the members in cooperation with the bushings 24, 26 and 28. In addition, the stud 30 provides a mounting for the outside operating lever 98, transfer lever 100, locking lever 102 and key cylinder lever 104. A cylindrical bushing 106 is mounted on stud 30 between the transfer lever 100 and the locking lever 102 and a coil torsion spring 108 surrounds the bushing. One leg 110 of the spring 108 engages the transfer lever 100, FIG. 6, and the other leg 112 of the spring seats against a wall portion 114 of the housing member 12 to bias the transfer lever clockwise as viewed in FIG. 4. The locking lever 102 includes a first pin 116 which is received within the arcuate slot 96 of the intermittent member 90 and a second pin 118 which is received within an enlarged slot 120 of the key cylinder lever 104.

Figure 6:
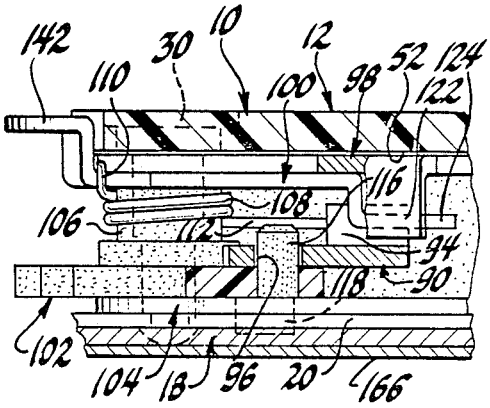
FIG. 6 is a sectional view taken along line 6—6 of FIG. 4.

As best shown in FIGS. 6 and 7, the outside operating lever 98 includes a lateral tab 122 which overlies the outwardly offset one end 124 of the transfer lever 100 to couple the levers 98 and 100 to each other upon clockwise movement of the operating lever 98.

The locking lever 102 is shown in FIG. 1 in its unlocked position with pin 116 located adjacent the lower end of the slot 96. In this position of the locking lever, the intermittent member is in coupled position wherein the lateral tab 94 of the intermittent member underlies the offset one end 124 of the transfer lever 100. When the locking lever 102 is in its locked position shown in FIG. 5, it is located counterclockwise of its position shown in FIG. 1 and the engagement of the pin 116 with the slot 96 has shifted the intermittent member 90 slightly clockwise about the pivot 92 to uncoupled position wherein the lateral tab 94 of the intermittent member no longer underlies the offset one end 124 of the transfer lever.

The free end of the operating lever 98 is conventionally connected to a manually operable outside operator such as a pull type or paddle type outside handle which rotates the lever 98 clockwise about stud 30 when the outside operator is manually operated. Upon such clockwise movement of lever 98, the engagement of the tab 122 with the offset one end 124 of lever 100 rotates the transfer lever 100 clockwise with the operating lever 98 about stud 30 against the bias of spring 108. The engagement of the offset one end 124 of lever 100 with the tab 94 of the intermittent member 90 shifts the intermittent member 90 downwardly as viewed in FIG. 1 to move the detent 70 to its released or undetented position shown in FIG. 4. This releases the bolt 58 for movement to unlatched position shown in FIG. 4. When the intermittent member 90 is in its FIG. 5 uncoupled position, clockwise movement of the transfer lever 100 by the operating lever 98 results in the offset one end 124 of the transfer lever bypassing the tab 94 of the intermittent member so that the detent remains in detented position. Spring 108 and tab 122 seat the free end of the operating lever 98 against the upper edge of the right hand opening 56, as shown in FIG. 1, to locate both levers 98 and 100 in unactuated position.

Figure 5:
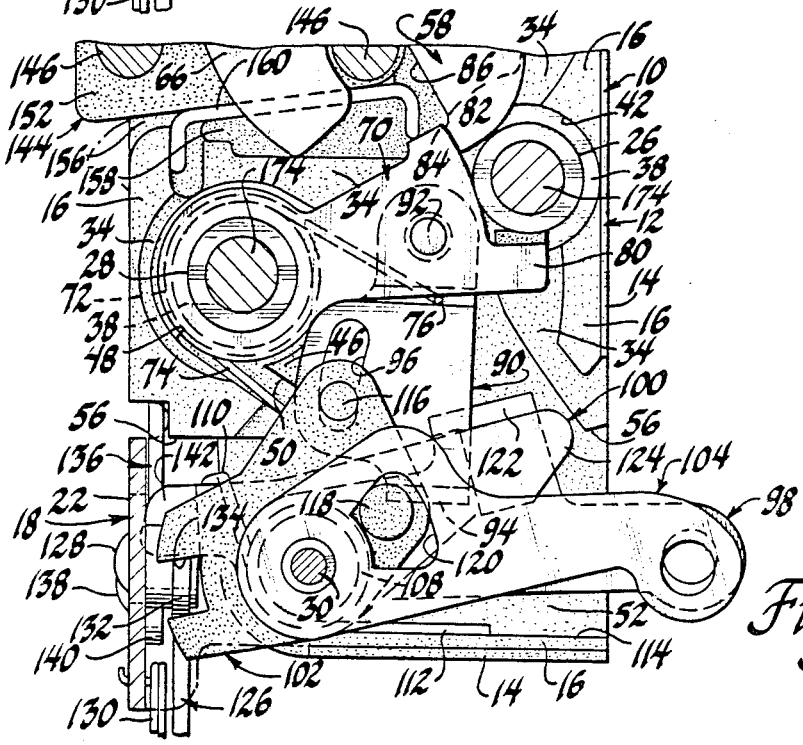
FIG. 5 is a view similar to FIG. 1 and showing the latch in locked condition.

The key cylinder lever 104 is conventionally connected to an outside key cylinder and moves the locking lever 102 between its unlocked position shown in FIG. 1 and its locked position shown in FIG. 5 through engagement of slot 120 with the pin 118.

Figure 4:
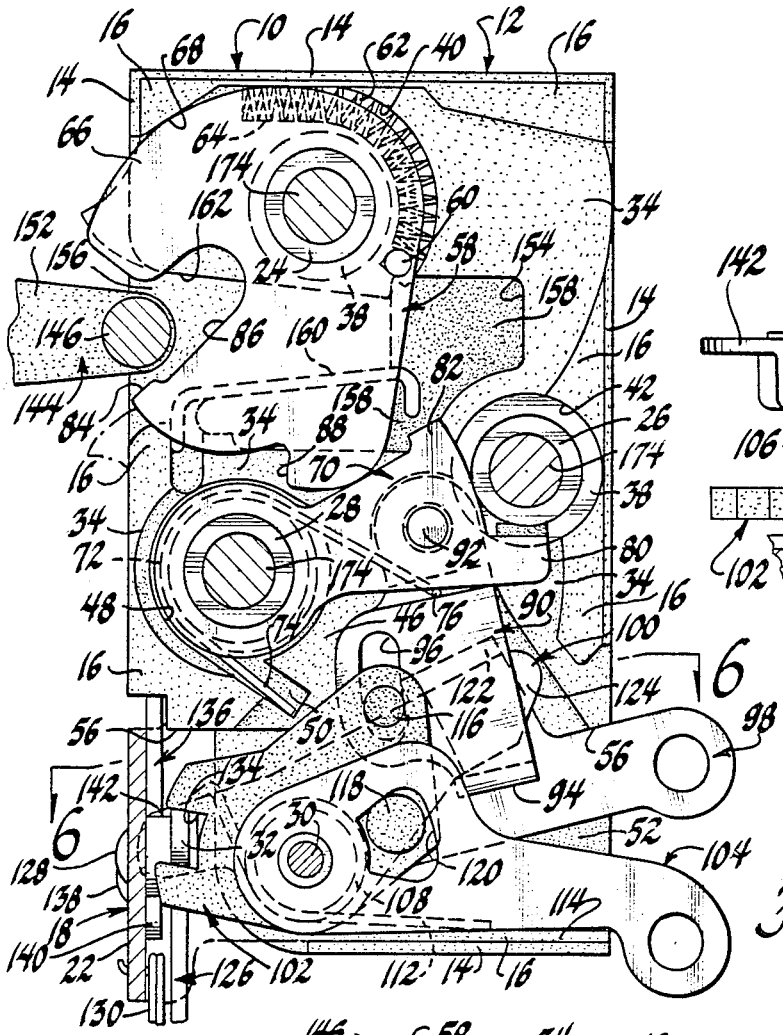
FIG. 4 is a view similar to FIG. 1 and showing the bolt in unlatched position.

It will be noted with reference to FIGS. 1, 4 and 5 that the key cylinder lever 104 and the outside operating lever 98 project outwardly or exit the housing member 12 through both sides thereof through openings 56.

Figure 3:
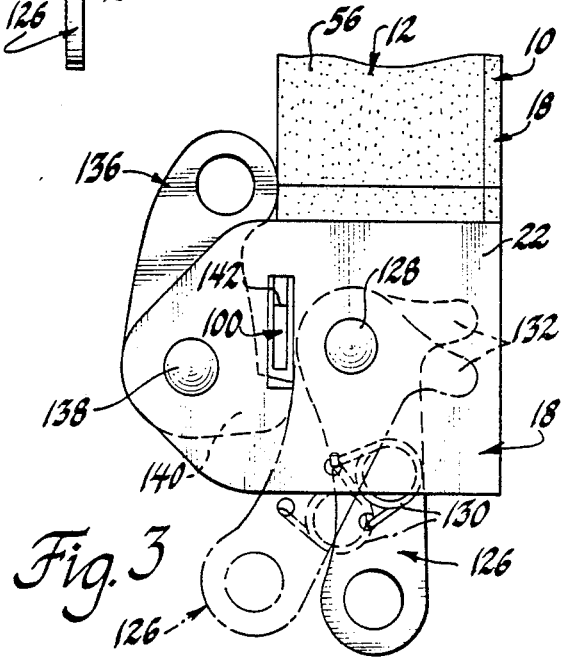
FIG. 3 is a view taken along line 3—3 of FIG. 1.

As best shown in FIGS. 1, 3 and 7, an inside locking lever 126 is pivoted at 128 to the side flange 22 of the frame member 18. An overcenter type hairpin spring 130 is hooked between the flange 22 and the lever 126 to locate this lever in either unlocked position, as shown in full lines in FIG. 3, or locked position as shown in dash lines in this Figure. The lever 126 is conventionally connected to an inside lock operator, such as a vertically reciprocable garnish button or a linearly shiftable slide button. The lever 126 includes a leg 132 which is received within a notch 134 of the locking lever 102 such that movement of the lever 126 between its locked and unlocked positions moves the locking lever 102 between its corresponding locked and unlocked positions. Pin 118 extends into an arcuate opening 135, FIG. 7 of portion 20 of frame 18. The engagement of the pin with the upper and lower edges of opening 135 locates lever 102 in locked and unlocked positions under the bias of spring 130.

An inside operating or remote lever 136 is pivoted at 138 to flange 22. This lever includes a leg 140, FIG. 3, which underlies the inwardly offset other end 142 of the transfer lever 100. The lever 136 is conventionally connected to an inside operator, such as an inside handle. Upon operation of such inside operator, the lever 136 is rotatable counterclockwise as viewed in FIG. 3. The engagement of leg 140 with end 142 of the transfer lever rotates the transfer lever clockwise as viewed in FIG. 1 against the bias of spring 108 to release the detent 70 as previously described and permit the bolt 58 to move to unlatched position.

Release of the detent 70 through operation of the outside operating lever 98 occurs independently of movement of the inside operating lever 136 and likewise, release of the detent 70 by the inside operating lever 136 occurs independently of movement of the outside operating lever 98. The locking lever 102 is moved between its locked and unlocked positions through operation of either the key cylinder lever 104 or the inside locking lever 126. When the locking lever 102 is moved by the inside locking lever 126, the pin 118 engages the upper end of the slot 120. When the locking lever 102 is moved by engagement of the slot 120 of lever 104 with the pin 118, the locking lever 126 remains stationary.

A loop type striker 144 includes a pair of legs 146 which are secured in a conventional manner, such as by heading over, to a mounting plate 148. The bight portion 150 of the striker 144 is partially flattened on opposite sides thereof, FIG. 2, and plastic wedge 152 is molded to the bight portion 150 in a conventional molding operation.

The housing member 12, as best shown in FIG. 7, includes a recess 154 which extends from the wall portion 34 to an inwardly recessed fifth base wall portion 156 of housing member 12. A generally L-shaped rubber bumper 158 fits within the recess 154. A metal plate 160 is attached to the longer leg of the rubber bumper. The plate 160 cooperates with a wall 162 between the second recessed base wall portion 34 and the fifth recessed base wall portion 158 to define a throat within the plastic housing member 12. Frame member 18 includes a throat 164 in alignment with the throat of housing member 12. The shape and size of this throat are the same as those of the plastic wedge 152.

When the latch 10 is mounted on a vehicle door, the frame member 18 abuts the free swinging end wall 166 of the door, FIG. 2, and flange 22 extends along the door inner panel. The throat 164 of housing member 12 of the frame member 18 are in alignment with a throat 168 in the end wall 166 and door inner panel of the door. The frame member 18 includes apertures 170 in alignment with the openings of bushings 24, 26 and 28 and the openings 172 in the end wall 166 of the door, FIG. 2. Bolts 174 extend through such aligned openings and into the threaded interiors of the bushings to mount the latch 10 on the door and additionally secure the housing member 12 to the frame member 18. The bolts 174 additionally increase the strength of latch 10 by applying compression force to members 12 and 18 through the bushings and by increasing the strength of bushings 24 and 28 to reinforce the pivots of bolt 58 and detent 70. The recessed corner portion 20 provides space for the head of stud 30, FIG. 2. The mounting plate 148 of the striker 144 is fixed to a body pillar wall to locate the wedge 152 in the path of the throat 168 and the throat in the housing member 12 and locate the legs 146 of the striker in alignment with throats 164 and 168.

Upon reference to FIG. 4, as the door is being closed, the leading leg 146 of the striker 144 will be engaged by the trailing or outboard edge of the throat 86 of bolt 58 to rotate the bolt counterclockwise from its unlatched FIG. 4 position to its latched FIG. 1 position. During this movement of the bolt from unlatched to latched positions, the detent shoulder 82 will first engage over the bolt shoulder 88 and then move into engagement with the bolt shoulder 84 under the bias of spring 72. As the bolt moves from unlatched to latched position, the leading leg 146 of the striker is trapped within the bolt throat 86, FIG. 1, and engages and partially compresses the shorter leg of the rubber bumper 158. Since the wedge 152 is molded on only the bight 150 of the striker 144, the bolt throat 86 can be made of minimum width to increase the strength of the bolt without increasing its size. This permits latch 10 to be of minimum size.

The wedge portion 152 of the striker 144 wedgingly engages the metal plate 160 and wall 162 and partially compresses the longer leg of bumper 158. This prevents up and down or chucking movement of the door relative to the body when bolt 58 is in latched position.

With reference to FIG. 1 of the drawings, when the bolt 58 is in latched position, it will be noted that the engaged shoulders 82 of the detent and 84 of the bolt are located between the flange 38 of the bushing 26 and the frame member 18 so as to be trapped therebetween and prevent any bypass of these shoulders relative to each other under load. Bolt 174 maintains frame member 18 tightly against bushing 26 to increase the strength of members 12 and 18 and bushing 26 in this area.

From the foregoing description it can be seen that the housing member 12 and the frame member 18 cooperatively provide a generally sealed housing for the components of the latch when they are assembled to each other by bushings 24, 26 and 18, stud 30 and bolts 174. The only openings into such housing are at 164 and 168 for entry and exit of the striker 144 and at 56 for exit of the outside operating lever 98 and the key cylinder lever 104. The frame member and the housing member are secured to each other only by the stud 30 when the latch 10 is initially assembled. When the latch 10 is mounted on the latch pillar face of the vehicle door, as shown in FIG. 2, bolts 174 increase the strength of the latch 10 and of the bushings 24 and 28 which provide pivots for the bolt 58 and detent 70. Such bolts can also serve to mount the latch 10 to a door beam or a door latch control module, partially indicated at 176 in FIG. 2. This mounting is easily accomplished since the inboard face of the housing member 12 is planar.

It will also be noted that all of the components of the latch 10 can be assembled by stacking through the open base wall of the housing member 12. This provides for ease of assembly. By locating the operating levers adjacent the bottom of the latch 10, the latch 10 has equal utility in both front and rear door applications.

Thus this invention provides an improved fork bolt type vehicle door latch.

The embodiments of the invention in which an exclusive property or privilege is claimed are defined as follows:

1. A vehicle door latch comprising, in combination, a plastic housing member having an inner base wall, upper and lower end walls, side walls, and an open outer base wall, a frame member extending over the open outer base wall of the housing member, means on the housing member supporting the frame member over the open outer base wall thereof, a bushing member seated in a recess in the inner base wall of the housing member and engaging the frame member to additionally support the frame member over the open outer base wall of the housing member, the bushing member having an intermediate flange seated on the inner base wall and spaced a predetermined distance from the frame member, a latch bolt mounted on the housing member for movement between latched and unlatched positions and having a latching shoulder, a detent mounted on the housing member for movement between detented and undetented positions, the detent having a detent shoulder engaged in detented position with the latching shoulder to maintain the latch bolt in latched position, the engaged shoulders of the latch bolt and of the detent being located between and overlapped by the flange of the bushing member and the frame member to prevent lateral bypass of one shoulder relative to the other shoulder under load.

2. A vehicle door latch comprising, in combination, a plastic housing member having an inner base wall, upper and lower end walls, side walls, and an open outer base wall, a frame member over the open outer base wall of the housing member, means on the housing member supporting the frame member over the open outer base wall thereof, an internally threaded bushing member having an inner portion seated in a recess in the inner base wall of the housing member, an outer portion engaging the frame member to additionally support the frame member over the open outer base wall of the housing member, and an intermediate flange seated on the inner base wall and spaced a predetermined distance from the frame member, a latch bolt mounted on the housing member for movement between latched and unlatched positions and having a latching shoulder, a detent mounted on the housing member for movement between detented and undetented positions, the detent having a detent shoulder engaged in detented position with the latching shoulder to maintain the latch bolt in latched position, the engaged shoulders of the latch bolt and of the detent being located between and overlapped by the flange of the bushing member and the frame member to prevent lateral bypass of one shoulder relative to the other shoulder under load, and a headed fastening member threaded into the bushing member and clamping the frame member against the outer portion of the bushing member to prevent movement of the frame member relative to the bushing member.

3. A vehicle door latch comprising, in combination, a plastic housing member having an inner base wall, upper and lower end walls, side walls, and an open outer base wall, a frame member extending over the open outer base wall of the housing member, means on the housing member supporting the frame member over the open outer base wall thereof, a plurality of internally threaded bushing members, each having an inner portion seated in a recess in the inner base wall of the housing member, an outer portion engaging the frame member to additionally support the frame member over the open outer base wall of the housing member, and an intermediate flange seated on the inner base wall and spaced from the frame member, a latch bolt mounted on the outer portion of one of the bushing members for movement between latched and unlatched positions and having a latching shoulder, a detent mounted on the outer portion of another of the bushing members for movement between detented and undetented positions, the detent having a detent shoulder engaged in detented position with the latching shoulder to maintain the latch bolt in latched position, the engaged shoulders of the latch bolt and of the detent being located between and overlapped by the flange of a further one of the bushing members and the frame member to prevent lateral bypass of one shoulder relative to the other shoulder under load, and headed fastening members threaded into the bushing members to clamp the frame member against the outer portions of the bushing members and prevent movement of the frame member relative to the bushing members.

* * * * *